US005667427A

United States Patent [19]

Airhart et al.

[11] Patent Number: 5,667,427

[45] Date of Patent: Sep. 16, 1997

[54] METHOD AND APPARATUS FOR SHARPENING CURVED BLADES

[75] Inventors: Forrest A. Airhart, Huron; Jeffrey Alan Whited, Amhert, both of Ohio

[73] Assignee: Bettcher Industries, Inc., Birmingham, Ohio

[21] Appl. No.: 530,840

[22] Filed: Sep. 20, 1995

[51] Int. Cl.[6] ..... B24B 1/00

[52] U.S. Cl. ..... 451/45; 451/224

[58] Field of Search ..... 451/192, 193, 451/45, 195, 196, 224, 380, 387

[56] References Cited

U.S. PATENT DOCUMENTS

| | | | |
|---|---|---|---|
| 1,126,891 | 2/1915 | Sheppard | 451/224 |
| 1,381,416 | 6/1921 | Heindl | 451/224 |
| 2,191,600 | 2/1940 | Wahl | 451/224 |
| 2,753,666 | 7/1956 | Sasse | 451/224 |
| 3,879,899 | 4/1975 | Ribar | 451/224 |
| 4,528,778 | 7/1985 | Wolff | 451/41.224 |
| 4,984,391 | 1/1991 | Sattler | 451/224 |
| 5,009,038 | 4/1991 | Yoshikawa et al. | 451/224 |
| 5,390,431 | 2/1995 | Friel | 451/45 |
| 5,431,597 | 7/1995 | Andersen | 451/45 |
| 5,480,343 | 1/1996 | Pederson et al. | 451/45 |

*Primary Examiner*—James G. Smith
*Assistant Examiner*—Dona C. Edwards
*Attorney, Agent, or Firm*—Watts, Hoffmann, Fisher & Heinke Co., L.P.A.

[57] ABSTRACT

A sharpener for blades comprises a movable blade-sharpening surface, a stationary blade guide supported closely adjacent the surface, and a movable support for a blade. The support comprises pivotally interconnected first and second links and a blade holder. The first link is pivotably supported at a location fixed with respect to the blade guide, the second link supports the blade holder adjacent a distal end of the second link. The links support the blade holder for movement in first directions toward and away from the blade-sharpening surface, in second directions transverse to the first directions, and in third directions transverse to the first and second directions. The blade holder is pivotably supported on the second link, with the links and pivots being located and ganged to support the blade holder adjacent the blade guide for movement in three substantially mutually perpendicular directions relative to the blade guide and blade-sharpening surface.

11 Claims, 6 Drawing Sheets

METHOD AND APPARATUS FOR SHARPENING CURVED BLADES

BACKGROUND

1. Field of the Invention

This invention relates to blade sharpening and more particularly to sharpening curved blades using power driven sharpeners and a mechanism for locating and guiding the blades during sharpening.

2. Prior Art

The present invention is an improvement over the sharpening device shown in U.S. Pat. No. 4,528,778, which provides a blade holder for moving a blade horizontally in a straight line across the face of a sharpening wheel and across a buffing wheel, both driven on a common shaft. The blade holder is supported by three pivoted links located midway between the two wheels. The blade holder can be removed from the supporting link after a blade is sharpened and resecured upside down to facilitate buffing the sharpened blade on the buffing wheel.

Many blades, including scissors blades used in the poultry industry, are curved. That is, the blades curve in a direction transverse to the direction of extent of the blade. Consequently, the blade cutting edge defines an arcuate line lying in a plane perpendicular to the direction of extent of the blade. When such a blade is ground with a single bevel terminating in the cutting edge, as is common with a scissors blade, the plane of the blade is inclined relative to the grinding surface as the blade is moved across the surface. That is, the major plane of the blade is not located in a plane that passes through the center of a grinding wheel. As a result of this orientation, the cutting edge and beveled face present a curved surface (approximating a conic surface section) to the blade-sharpening surface.

If sharpening a curved blade is attempted using the prior art sharpening device, the blade is maintained in contact with the wheel while being drawn across the wheel periphery in a direction parallel to the wheel axis. The blade supporting pivoted links are constrained against motion out of a horizontal plane so that, although the curved blade can be engaged with the wheel and moved horizontally across the wheel periphery, the blade can not be shifted vertically relative to the wheel. Because the blade curves, the locus of engagement between the wheel periphery and the blade will shift about the wheel periphery as the blade moves. Shifting the locus of engagement in this manner will change the bevel angle proceeding along the blade and, at least eventually, produce a cutting edge which no longer lies in the plane perpendicular to the direction of extent of the blade. Consequently, blade performance, particularly in the case of curved scissors blades, may degenerate over time with repeated sharpenings.

The present invention provides a new and improved blade sharpening method and apparatus effective to sharpen curved blades so that the cutting edge remains substantially disposed in a plane perpendicular to the direction of extent of the blade even after numerous sharpenings.

SUMMARY OF THE INVENTION

According to a preferred embodiment of the invention a method of sharpening an elongated curved blade defining a blade edge lying in a plane comprises: Moving a sharpening surface along a predetermined path of travel, the surface having a width substantially less than the extent of the blade; stationing a blade engaging guide adjacent the path of travel; fixedly supporting the blade on a blade support with the blade extending in a direction transverse to the surface and the blade edge projecting away from the support; resiliently urging the blade, guide and sharpening surface into engagement so that the surface engages the blade edge; shifting the blade support to draw the blade edge across the surface and shifting the blade support in a direction transverse to the extent of the blade while maintaining the blade in engagement with the guide and the surface.

This is accomplished by providing a movable support linkage fixed at one point relative to the blade sharpening surface. The linkage supports the blade against a stationary blade guide at the blade sharpening surface and guides blade movement in directions both across the surface and along the surface in a plane tangential to the surface. This permits locating the major surface of a curved blade at an appropriate angle to the surface while moving the blade both longitudinally across the surface and tangentially relative to the surface. The angular relationship between the blade and surface is maintained substantially constant.

In addition, the linkage provides a universal pivot between two links supporting a blade holder that not only permits the movements described above, but also permits the link to which the blade holder is directly attached to be pivoted 180 degrees to place the blade holder adjacent a second blade sharpening surface at an appropriate angle and location and for the same directions of movement relative to the second surface as to the first and in contact with a second stationary blade guide, to buff the sharpened edge of the blade.

A preferred embodiment of the present invention provides a sharpener for blades having a movable blade-sharpening surface, a stationary blade guide closely adjacent the surface, a movable support for a blade, the support comprising pivotally interconnected first and second links, the first link pivotably supported at a location fixed with respect to the blade guide, the second link supporting a blade holder adjacent a distal end of the second link, the two links together supporting the blade holder for movement in first directions toward and away from the blade sharpening surface, in second directions transverse to the first directions, and in third directions transverse to the first and second directions, and the blade holder being pivotably supported on the second link, the links and pivots being located and arranged to support the blade holder adjacent the blade guide for movement in three substantially mutually perpendicular directions relative to the blade guide and blade-sharpening surface. Advantageously, a spring biases the blade support in one of the third directions, to urge a supported blade into contact with the stationary blade guide.

In a preferred embodiment, the invention provides a sharpener for blades, first and second wheels each having a blade-sharpening surface rotatable in the same direction on a common axis, two stationary blade guides, each located adjacent to a different one of the surfaces, and a movable support for a blade, the support comprising a blade holder and pivotally interconnected first and second links, the first link pivotably supported at a location fixed with respect to the blade guide and midway between the two wheels, the second link supporting the blade holder adjacent a distal end of the second link, the two links together supporting the blade holder for movement in first directions toward and away from the either blade-sharpening surface, in second directions transverse to the first directions, and in third directions transverse to the first and second directions, the blade holder being pivotably supported on the second link, the links and pivots being located and arranged to support the blade holder adjacent either blade guide for movement in three substantially mutually perpendicular directions relative to either blade guide and blade-sharpening surface. Preferably, a spring biases the blade support in one of the third directions to urge a supported blade into contact with one of the stationary blade guides. Most advantageously, the second link is pivoted for movement through 180 degrees to locate the blade holder adjacent either of the two wheels, reversing the orientation of a supported blade relative to the second wheel with respect to its orientation relative to the first wheel.

These and other features of the invention are described in more detail in the description of a preferred embodiment, which follows.

DETAILED DESCRIPTION OF A PREFERRED EMBODIMENT

Figure 3:
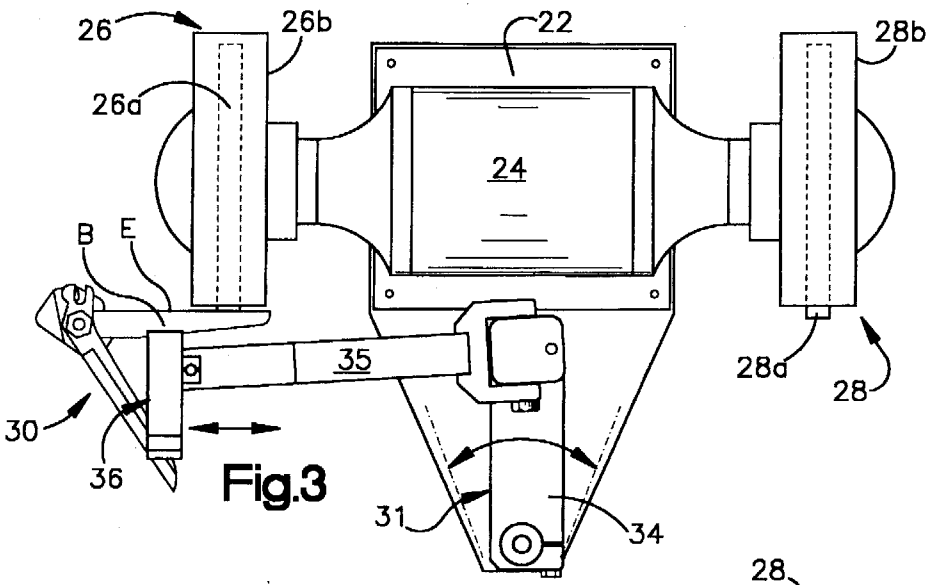
FIG. 3 is a view seen approximately from the plane indicated by the line 3—3 of FIG. 1.
Figure 1:
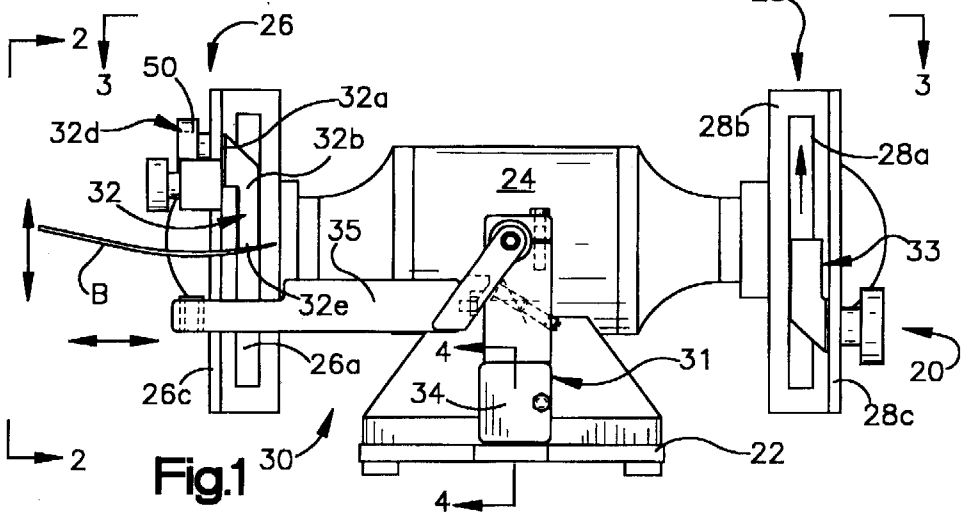
FIG. 1 is an elevational view of a sharpener constructed according to the present invention shown with parts removed, or broken away or shown schematically.

Referring to the drawings, a sharpener 20 is shown having a base 22, a motor 24 secured to the base, blade-sharpening stations 26, 28 on opposite sides of the motor, and a blade support system 30 positioning a blade B for sharpening and manipulating the blade B during the sharpening process. See FIGS. 1–3.

The illustrated blade B is an elongated scissors blade defining a cutting edge E and a beveled face F extending from the edge E. See FIGS. 7 and 7A. The blade B curves in a direction transverse to the direction of extent of the blade. The blade cutting edge E defines an arcuate line lying in a plane perpendicular to the direction of extent of the blade. The blade is sharpened, or ground, with a single beveled face F terminating in the cutting edge E. The cutting edge E and beveled face F form a curved surface approximating a conic surface section.

The illustrated and preferred sharpener 20 is constructed and arranged so that each sharpening station 26, 28 comprises a sharpening wheel (numbered **26*a*, 28*a*, respectively) directly driven by the motor shaft, and an associated guard assembly (26*b*, 28*b***, respectively) fixed to the motor housing and substantially enclosing the wheel.

Figure 2:
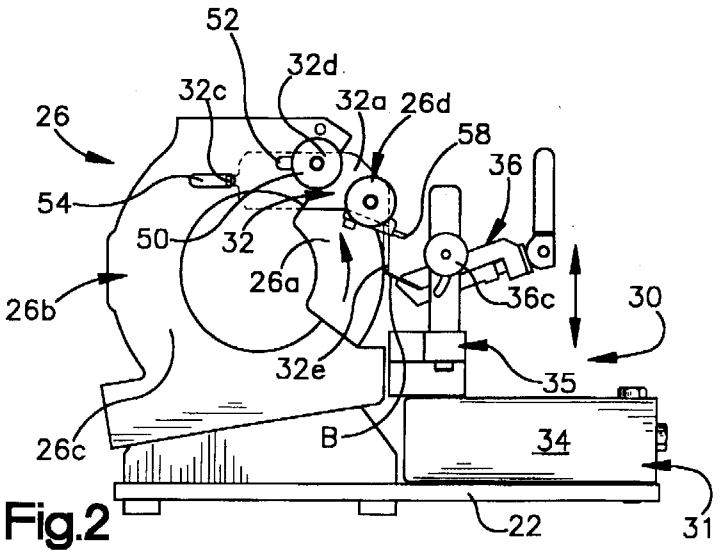
FIG. 2 is a view seen approximately from the plane indicated by the line 2—2 of FIG. 1.

The wheels **26*a*, 28*a* are respectively connected to opposite ends of the motor shaft, which project from opposite ends of the motor housing. The wheels thus rotate in the same direction, (counter-clockwise as shown in FIG. 2) and as illustrated by directional arrows in the drawings. Each wheel is narrow in width and quite narrow in proportion to the extent of the blade B so that each defines a peripheral blade sharpening surface. The wheel 26*a* is a grinding wheel for sharpening the blade edge E. The wheel 28*a*** is a buffing wheel for creating a fine, burr-free edge on a Found blade. Edge sharpening normally takes place when the grinding wheel periphery moves into the cutting edge and grinds material along the face F in the direction proceeding toward the edge E. Buffing is accomplished with the wheel periphery moving in the opposite direction relative to the cutting edge E.

The guard assemblies **26*b*, 28*b* are formed by sheet metal fender-like shields disposed about each wheel so that only a portion of the periphery of each wheel is exposed and capable of engaging the blade. The assemblies further include sheet metal side plates 26*c*, 28*c*** for enclosing the axial outer sides of the wheels, and suitable fasteners for securing the side plates to the shields and the shields to the motor housing.

The sharpening station 26 further comprises a blade steeling assembly **26*d* for bending a wire edge left on the blade B by the grinding operation. The bent edge is then removed by a buffing operation at the station 28**.

The blade support system 30 comprises a blade support mechanism 31 for carrying the blade during sharpening and blade guide assemblies 32, 33 for maintaining the blade-wheel relationship constant. The illustrated blade support mechanism 31 is mounted on the base 22 between the stations 26, 28 and is formed by an articulated linkage to which the blade B is detachably fixed. Each guide assembly 32, 33 is associated with a respective sharpening station 26, 28. The support mechanism 31 presents the blade B to the guide assemblies 32, 33, respectively, to engage the blade with the respective guide assembly and wheel during sharpening.

The support mechanism 31 comprises a first link 34 pivoted to the base 22, a second link 35 pivoted to the first link for limited universal movement, and a blade holder 36 pivoted to the second link. The links and pivots are located and arranged to support the blade holder 36 adjacent a blade guide for movement in three substantially mutually perpendicular directions relative to the blade guide and blade-sharpening surface. The links 34, 35 are manually manipulated to locate the blade holder 36 adjacent either wheel. When the blade B is located as desired, the links are shifted both to guide blade movement across the wheels (parallel to their rotation axis) and in a direction generally tangential to the wheel surfaces.

Figure 4:
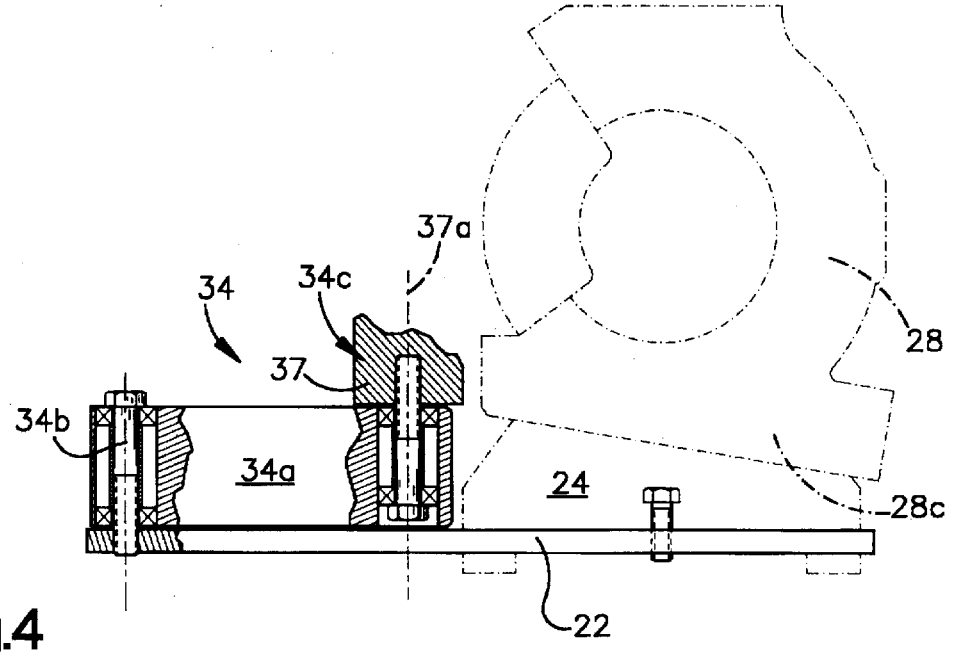
FIG. 4 is a view seen approximately from the plane indicated by the line 4—4 of FIG. 1.
Figure 5:
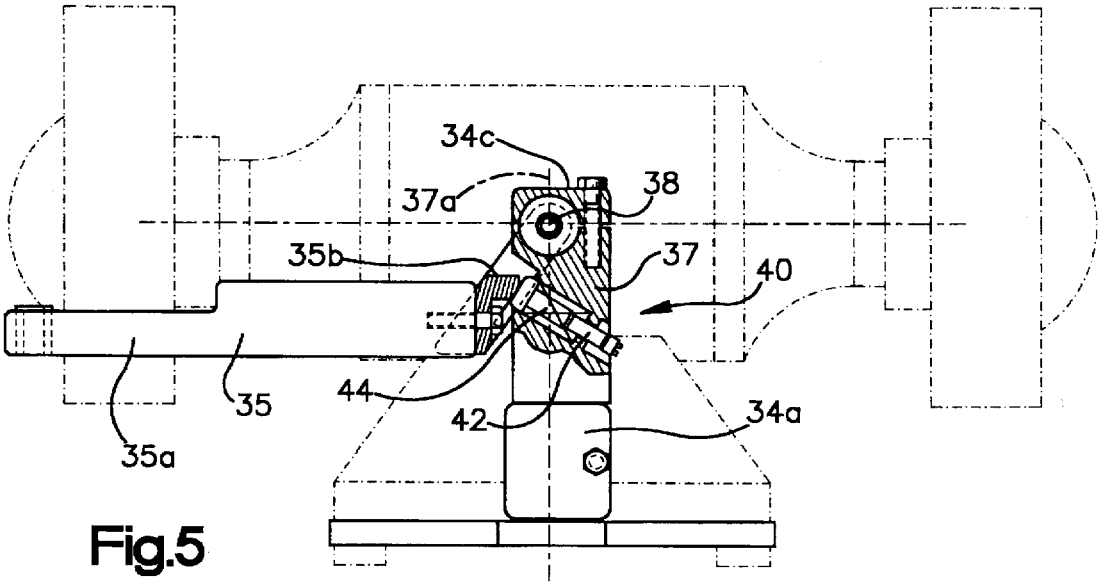
FIG. 5 is a view similar to FIG. 1 with parts shown schematically in broken lines and parts shown partially in cross section.
Figure 6:
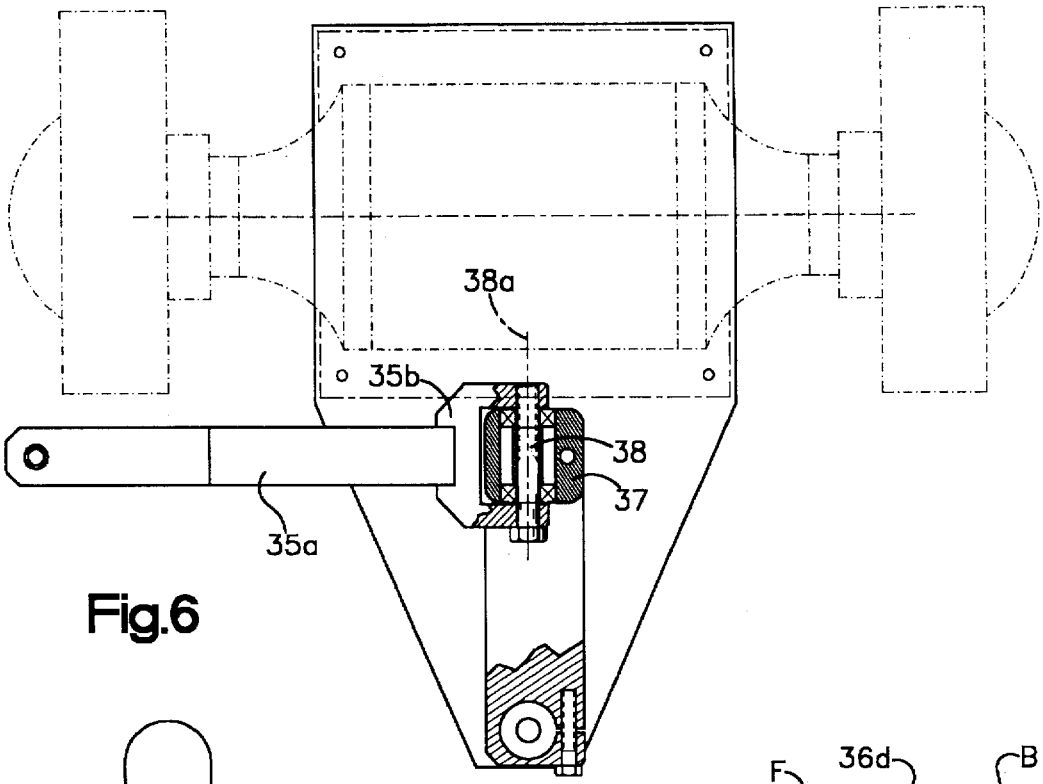
FIG. 6 is a view similar to FIG. 3 with parts shown schematically in broken lines and parts shown partially in cross section.

Referring now to FIGS. 4–6, the link 34 comprises an arm **34*a* manually rotatable in a plane parallel to the axis of rotation of the wheels, a pivot pin 34*b* pivotally anchoring the arm 34*a* to a base section projecting from the motor housing between the stations 26, 28 and an articulating assembly 34c securing the arm 34a to the link 35. The arm 34a is an elongated member having a rectangular cross section. The pivot pin 34b defines a smooth cylindrical body extending through bearing assemblies (not illustrated) mounted in the arm 34a, and a threaded end which is screwed into a threaded opening in the base 22. The arm 34a rotates easily about the pivot pin 34b. The axis of the pin 34b extends in a plane which is normal to the axis of rotation of the wheels 26a, 28a**.

The articulating assembly 34c supports the link 35 for limited universal motion relative to the link 34. The assembly 34c is connected to the end of the arm 34a opposite from the pivot pin 34b and thus rotates about the pivot pin 34b with the arm 34a. The assembly 34c comprises a body 37 pivoted to the arm 34a for rotation about an axis 37a parallel to the axis of the pin 34b, and a trunnion 38 connecting the arm 35 to the body 37. The body 37 is an elongated part extending in the direction of its axis of rotation. The illustrated body 37 is connected to the arm 34a by a pivot pin and ball bearing construction like that described above in connection with the pin 34c. The trunnion is formed by a pivot pin supported in the projecting end of the body 37 by bearing assemblies along an axis 38a transverse to the body pivot axis 37a. The various bearing assemblies are conventional and not illustrated.

The link 35 is connected to the body 37 both for rotation with the body 37 about the axis 37a and rotation with respect to the body 37 about the trunnion axis 38a. The link 35 comprises an arm 35a, a yoke 35b securing the arm 35a to the body 37 via the trunnion 38, and a blade holder pivot pin 39 at the distal end of the arm 35a. The illustrated arm 35a is fixed to the yoke 35b to define a dog-leg shape (FIG. 5) with the juncture of the yoke and arm welded together to form an oblique angle. The yoke 35b defines arms projecting to opposite ends of the trunnion 38. The trunnion 38 is a bolt-like member having a wrench flat defining head engaging one yoke arm, a smoothly cylindrical central body rotatably received by bearings in the body 37 and a threaded projecting end screwed into the other yoke arm. The yoke 35b and arm 35a rotate as a unit about the trunnion axis 38a.

The arm 35a supports the blade holder 36 for rotation relative to the arm 35a. about the axis 35c of a pivot pin 35d. See FIG. 7. The blade holder supporting pivot pin 35d is a bolt-like element having a head with wrench flats, a smooth cylindrical body and a projecting threaded end screwed into the blade holder 36. The smooth body is slidably received in a bushing mounted in the projecting end of the arm 35a.

The blade holder 36 is similar to the blade holder disclosed by U.S. Pat. No. 4,528,778 referred to above. The illustrated blade holder (FIGS. 7 and 7A) is constructed and arranged to securely grip a curved blade B and maintain the blade in sharpening contact with the wheels 26a, 28a. The blade holder 36 comprises a body 36a attached to the arm 35a by the pivot pin 35d, a blade clamping mechanism 36b for detachably securing a blade in position for sharpening, and a clamp positioner 36c for adjusting the position of the blade damping mechanism 36b on the body.

The body 36a extends along the axis 35c and supports the blade clamping mechanism 36b for rotation about that axis. The mechanism 36b comprises a stationary jaw 36d, a clamp jaw 36e movable between damped and declamped positions relative to the stationary jaw, and a jaw actuating mechanism 36f. The jaw 36d is secured to the body 36a by the positioner 36c. The jaw 36e is slidably supported on the jaw 36d.

The jaw actuating mechanism 36f comprises a support rod 36g for the movable jaw 36e, a spring 36h (both schematically shown) for biasing the clamp jaws to a declamped position, and a cam lever 36i mounted on the rod 36g for engagement with the jaw 36d. The rod is screwed into a tapped hole in the jaw 36e (and thus fixed to the jaw 36e) and slidably extends through a bore in the jaw 36d to the cam lever. The cam lever is pivotally fixed to the end of the rod 36g and engages the fixed jaw 36d. When the cam lever is manually rotated in one direction relative to the rod end, the movable jaw is acted upon by the spring to shift to its declamped position where a blade B can be removed from and inserted into position between the clamp jaws. Rotation of the cam lever in the opposite direction pulls the movable jaw, via the rod 36g, against the spring biasing force to close the jaws against the blade B.

The central section of each damp jaw is formed with a relieved area to accommodate the curvature of the blade B. See FIG. 7A.

Figure 7A:
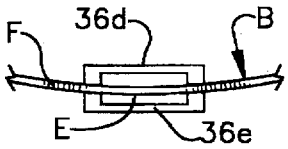
FIG. 7A is a view seen approximately from the plane indicated by the line 7A—7A of FIG. 7.
Figure 7:
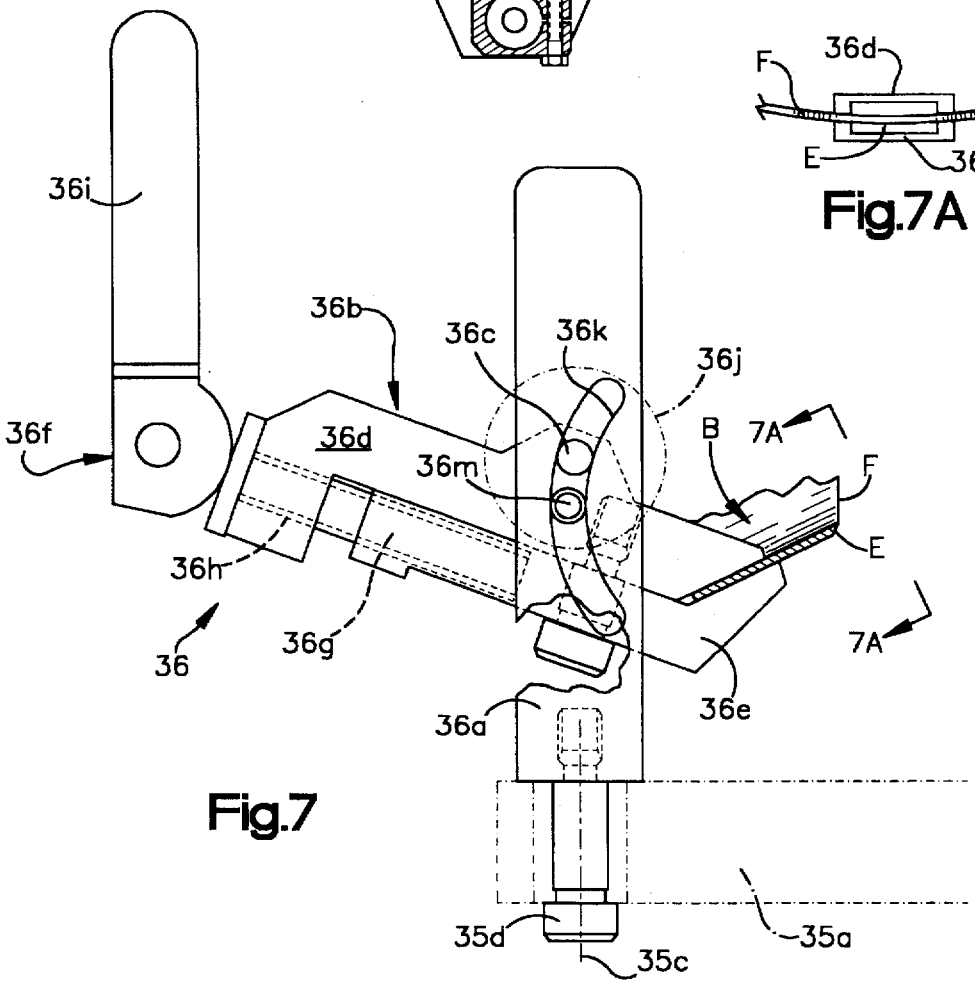
FIG. 7 is a view seen approximately from the plane indicated by the line 7—7 of FIG. 3.

The stationary jaw 36d is connected to the body 36a by the clamp positioner 36c so that the angle between the blade and the wheel periphery can be altered between limits. This structure thus adjusts the angular relationship between the wheel 26a periphery and the beveled face F of the blade B leading from the cutting edge E. The positioner comprises a clamping knob 36j having a projecting threaded shaft portion, a semi-circular guide slot 36k in the body 36a and a positioning pin 36m fixed in the jaw 36d and projecting through the slot 36k. The slot 36k coacts with the clamp knob 36j and the pin 36m to position the stationary jaw as desired for sharpening a blade B. The threaded shaft portion of the knob 36j extends through the guide slot 36k and into a tapped hole in the jaw 36d. As the knob 36j is turned, the body 36a is clamped between the knob and the jaw 36d so that the jaw, and therefore the entire blade holder, is secured in a predetermined position relative to the wheel periphery. The slot 36k is circularly curved about a center of curvature coextensive with the blade cutting edge segment E located between the jaws 36d, 36e (FIG. 7A). The pin 36m maintains the holder 36 properly aligned with the slot throughout the range of adjusted holder positions.

The sharpener 20 is so constructed and arranged that the blade B is biased into engagement with each guide assembly and the steeling assembly during the sharpening process. When the blade is being sharpened on the wheel 26a, or steeled, the blade is biased into engagement with the guide assembly 32, or the steeling assembly 26d, by a spring mechanism 40 (FIGS. 1 and 5) forming part of the support mechanism 31. In the illustrated embodiment of the invention the spring mechanism 40 reacts between the body 37 and the link 35 to bias the blade B against the guide assembly 32 and the wheel (26a) periphery. The spring mechanism 40 comprises a plunger 42 carried by the body 37 and a compression spring 44 surrounding the plunger and urging it into driving engagement with the yoke 35b to force the second link 35 upwardly against gravity. The relationship between the contact location on the link 35, the plunger and the spring is such that the link 35 extends from the trunnion 38 at an angle inclined above horizontal when the blade holder supports a scissors or other blade. The spring 44 yieldably biases the link 35 to the orientation above the horizontal when the link extends the blade holder 36 to the wheel 26a. The sharpener operator must manually depress the link 35 against the spring force in order to engage the blade B with the guide assembly 32. Afterwards the spring force maintains the blade engaged with the guide assembly.

When the blade B is presented to the wheel 28a for sharpening, the blade B is biased against the guide assembly 33 by the force of gravity and the spring mechanism is not employed.

Each blade guide assembly 32, 33 maintains the blade B at the desired location on the respective associated wheel surface as the blade moves across the wheel surface. The sharpening process is begun by grinding the blade B on the wheel 26*a*. See FIGS. 1–3. The machine operator manipulates the mechanism 31 to present the blade B to the wheel 26*a* and contact the guide assembly 32. The assembly 32 comprises a sheet metal guide body 32*a* detachably secured inside the side plate 26*c*, a blade guide 32*b* projecting from the body 32*a* along the wheel 26*a* to a location immediately adjacent the wheel periphery and horizontally aligned with the wheel axis, a stabilizer tab 32*c* (FIG. 2), and a positioning clamp 32*d* for repositioning the assembly 32 as the wheel 26*a* wears and the diameter reduces.

The guide body 32*a* is substantially flat with the blade guide 32*b* and tab 32*c* formed continuously with the body. The blade guide 32*b* is bent out of the plane of the body 32*a* and projects toward the wheel periphery, as described. The guide tip 32*e* lies immediately adjacent the wheel periphery in horizontal alignment with the wheel axis for engaging the blade B during sharpening. The tip 32*e* is slightly rounded to assure minimum contact area with, and minimum frictional resistance to motion of, the blade B as it passes across the wheel.

The clamp 32*d* comprises a knob 50 having a threaded shaft extending into a tapped hole in the body 32*a* through an adjusting slot 52 (FIG. 2) formed in the side plate 26*c*. The knob 50 has a shoulder which engages the side plate 26*c* along the margin of the slot 52 so that when the knob is turned to advance its shaft threads into the tapped body hole the knob shoulder and body 32*c* are dram into clamping engagement with the side plate. The slot 52 extends along a straight line in the side plate 26*c*. The knob 50 is unscrewed to loosen the clamp for repositioning the body along the direction of extent of the slot. The slot is located so that the guide 32 is repositioned with the tip 32*e* always adjacent the periphery of the wheel in horizontal alignment with the wheel axis.

The stabilizer tab 32*c* coacts with the clamp 32*d* to maintain the guide 32 properly aligned with the wheel during use. The tab 32*c* projects through an adjustment slot 54 in the side plate and prevents the guide 32 from tipping about the clamp knob 50 axis during sharpening. The tab 32*c* slides along the slot 54 when the guide 32 is repositioned to accommodate wheel wear. Accordingly the slot 54 extends parallel to the slot 52.

Figure 9:
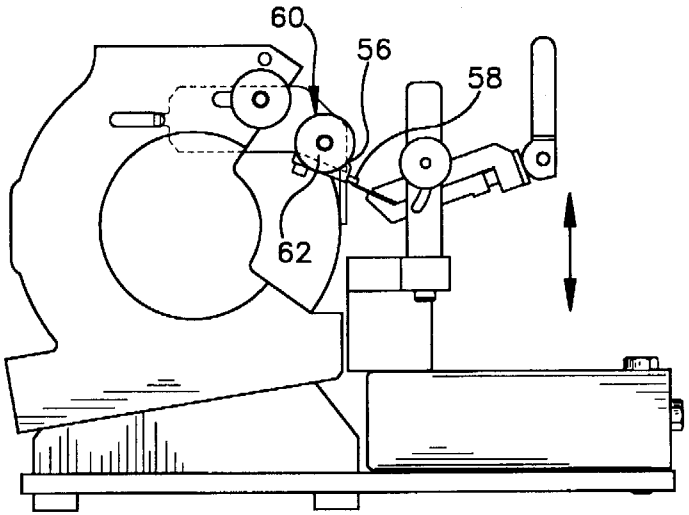
FIG. 9 is a view similar to FIG. 2 with parts shown in alternate positions.
Figure 8:
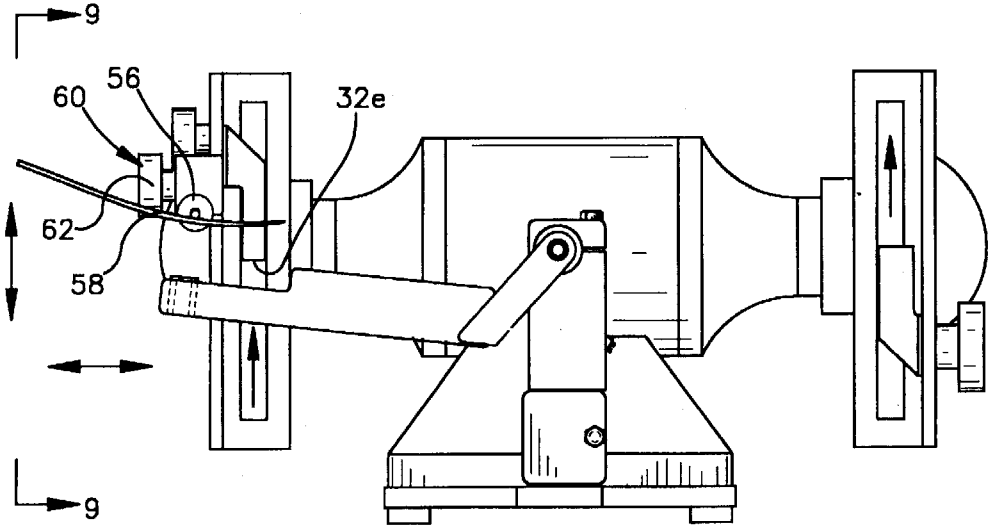
FIG. 8 is a view similar to FIG. 1 with parts shown in alternate positions.

The blade steeling assembly 26*d* is positioned so that the blade B can be manually drawn across it to straighten the blade after grinding as well as to remove blade burrs. The grinding operation may leave a burr projecting from the blade. Burrs that the steel does not detach from the blade are bent by the steel into positions where they are removed by the buffing wheel. In the sharpener illustrated by the drawings the steeling assembly 26*d* is connected to and supported by the blade guide assembly 32. FIGS. 8 and 9 illustrate the steeling operation being performed. The assembly 26*d* comprises a steel supporting body 56, a blade sharpening steel element 58 detachably supported by the body 56, and a clamp 60 for detachably securing the body 56 to the guide assembly body plate 32*a*. The illustrated body 56 defines a steel element supporting bore. The steel element is generally cylindrical and slidably received in the bore. A set screw threaded into the body 56 is advanced into engagement with the steel element to fix its position in the body 56. The steel element may be of any conventional or suitable construction and therefore is not illustrated in detail or described further.

The steel assembly damp 60 comprises a damp knob 62 and projecting threaded shaft. The shaft projects through a clearance hole in the steel supporting body 56 and is received by a tapped hole in the guide body 32*a*. The knob 60 has a shoulder which engages the body 56 about the clearance hole so that when the knob is turned to advance its shaft threads into the tapped guide body hole the knob shoulder and body 32*c* are drawn into damping engagement with the steel supporting body 56 to secure the steeling assembly in place. The steel element can be adjustably oriented with respect to the blade B if desired to perform blade straightening operations.

Figure 12:
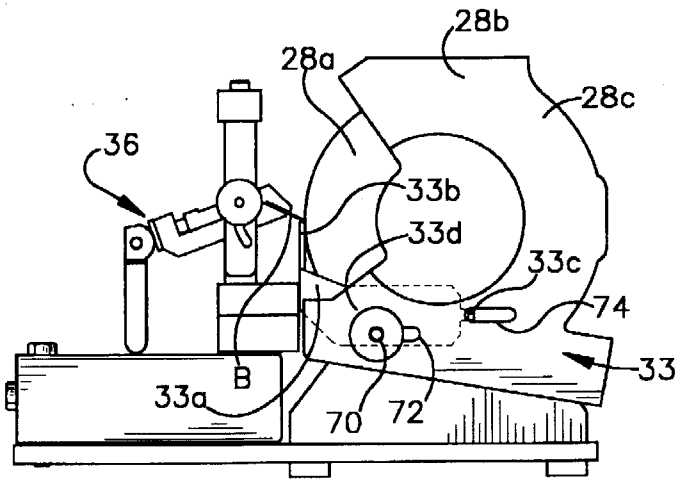
FIG. 12 is a view similar to FIG. 2 with parts shown in alternate positions, and, FIG. 13 is a perspective view of a blade guide forming part of the sharpener.
Figure 11:
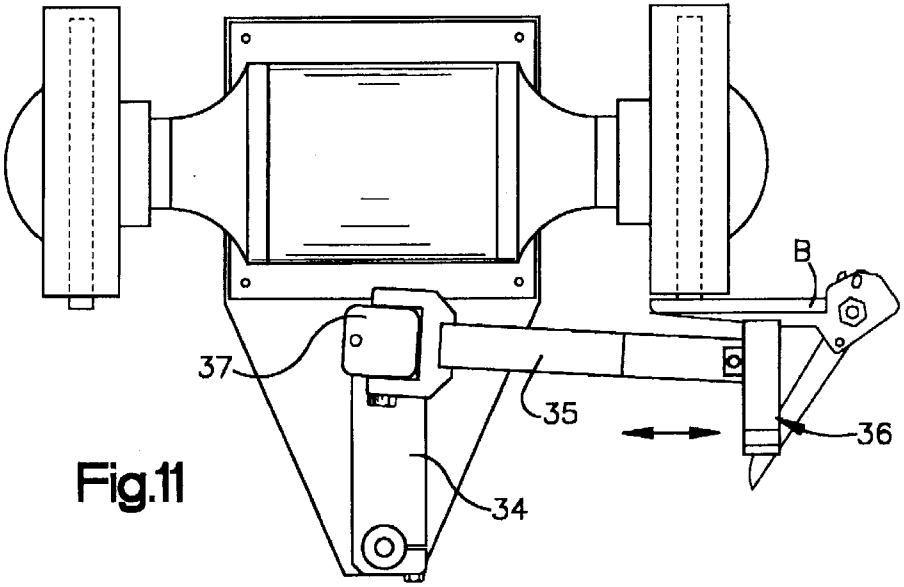
FIG. 11 is a view similar to FIG. 3 with parts shown in alternate positions.
Figure 10:
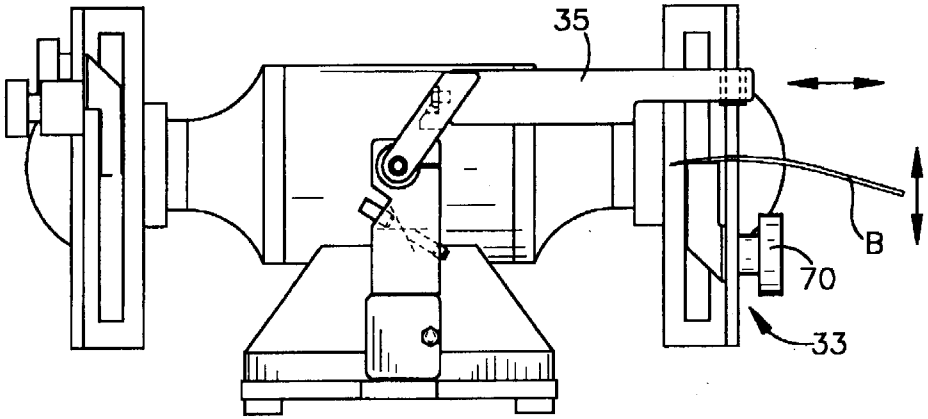
FIG. 10 is a view similar to FIG. 1 with parts shown in alternate positions.
Figure 13:
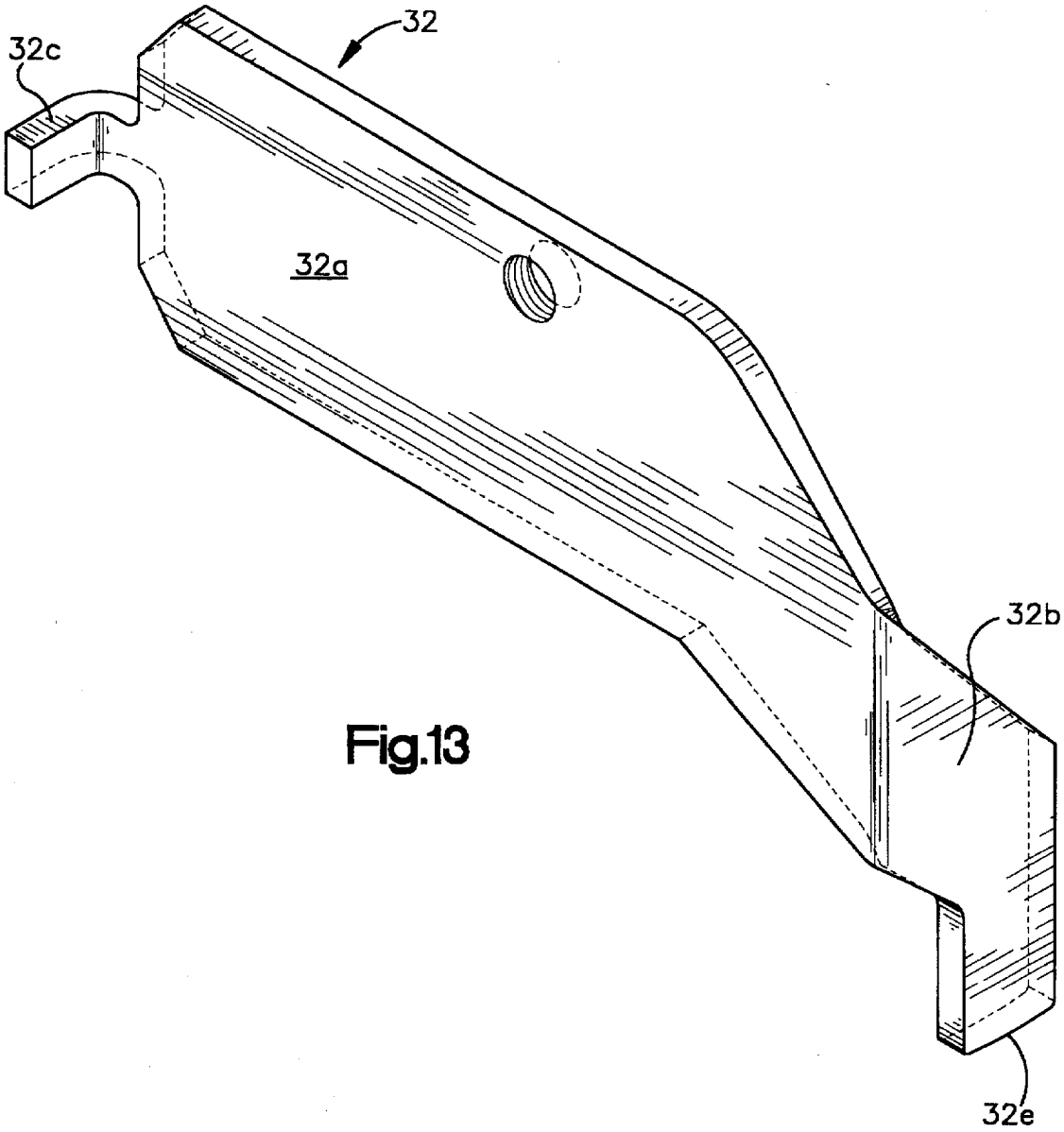

The sharpening station 28 in the illustrated embodiment of the invention performs a buffing operation on the ground and steeled blade B to remove all burrs from the blade. FIGS. 10–12 illustrate the buffing operation. Because both wheels 26*a*, 28*a* move in the same direction, it is necessary to reverse the orientation of a blade B between the grinding operation and the buffing operation. The prior art sharpener referred to above required reclamping or otherwise physically remounting a blade or blade holder on its supporting structure between grinding and buffing operations to reverse the blade orientation. These additional steps must be performed manually and are time consuming and nonproductive.

The blade support mechanism 31 and blade guide assembly 33 are so constructed and arranged that the sharpening operation performed at the station 28 is accomplished without requiring any adjustments to the blade B or its holder. As illustrated by FIGS. 10-12, the mechanism 31 is manipulated so that the trunnion axis 38*a* extends in a direction substantially normal to the direction of extent of the wheel axis and the link 35 is then rotated 180 degrees from its FIG. 1 position to its FIG. 10 position to begin the buffing operation. As noted previously, the link 35 is moved away from, and out of engagement with, the spring mechanism 40, but is biased into engagement with the guide assembly 33 by gravity.

The blade guide assembly 33 comprises a sheet metal guide body 33*a* detachably secured in inside the side plate 28*c*, a blade guide 33*b* projecting from the body 33*a* along the wheel 28*a* to a location immediately adjacent the wheel periphery and horizontally aligned with the wheel axis, a stabilizer tab 33*c*, and a positioning clamp 33*d* for repositioning the assembly 33 as the wheel 28*a* wears and its diameter reduces. The blade guide assembly 33 is essentially like the blade guide assembly 32 but is connected to the lower portion of the side plate 28*c* with the blade guide 33*b* projecting upwardly from the body to the wheel periphery rather than downwardly as in the case of the blade guide 32*b*. The orientation of the blade guide 33 is thus reversed from the orientation of the blade guide 32, which is necessitated by the reversal of the blade orientation between the grinding and buffing operations.

The guide body 33*a* is substantially flat with the blade guide 33*b* and tab 33*c* formed continuously with the body. The blade guide 33*b* is bent out of the plane of the body and projects toward the wheel periphery, as described. The guide tip 33*e* lies immediately adjacent the wheel periphery in horizontal alignment with the wheel axis for engaging the blade B during buffing. The tip 33*e* is slightly rounded to assure minimum contact area with, and minimum frictional resistance to motion of, the blade B as it passes across the wheel.

The clamp 33*d* comprises a knob 70 having a threaded shaft extending into a tapped hole in the body 33*a* through an adjusting slot 72 formed in the side plate 28*c*. The knob 70 has a shoulder which engages the side plate 28*c* along the margin of the slot 72 so that when the knob is turned to advance its shaft threads into the tapped body hole the knob shoulder and body 33*c* are dram into clamping engagement with the side plate. The slot 72 extends along a straight line in the side plate 28*c*. The knob 70 is unscrewed to loosen the damp for repositioning the body along the direction of extent of the slot. The slot is located so that the guide 33 is repositioned with the tip 33*e* always adjacent the periphery of the wheel in horizontal alignment with the wheel axis.

The stabilizer tab 33*c* coacts with the clamp 33*d* to maintain the guide assembly 33 properly aligned with the wheel during use. The tab 33*c* projects through an adjustment slot 74 in the side plate and prevents the guide assembly 33 from tipping about the clamp knob 70 axis during sharpening. The tab 33*c* slides along the slot 74 when the guide 33 is repositioned to accommodate wheel wear. Accordingly, the slot 74 extends parallel to the slot 52.

While only a single embodiment of a preferred form of the invention has been shown and described herein the present invention is not to be considered limited to the precise construction disclosed. Various modifications, adaptations and uses of the invention may occur to those skilled in the business to which the invention relates. It is the intention to cover all such adaptations, modifications and uses falling within the spirit or scope of the appended claims.

We claim:

1. A sharpener for blades comprising:

a movable blade-sharpening surface, a stationary blade guide supported adjacent the surface, and a movable support for a blade, said support comprising pivotally interconnected first and second links and a blade holder, the first link pivotably supported at a location fixed with respect to the blade guide, the second link supporting the blade holder adjacent a distal end of the second link, the second link pivotally interconnected to the first link for movement in two different planes with respect to the first link, the two links together supporting the blade holder for movement in first directions toward and away from the blade-sharpening surface, in second directions transverse to the first directions, and in third directions transverse too the first and second directions, and said blade holder being pivotably supported on the second link, the links and pivots being located and arranged to support the blade holder adjacent the blade guide for movement in three substantially mutually perpendicular directions relative to the blade guide and blade-sharpening surface.

2. A sharpener as set forth in claim 1 including a spring that biases the blade support in one of said third directions.

3. A sharpener as set forth in claim 1 wherein the pivotal interconnection between the first and second links has first and second pivots with orthogonally related axes.

4. A sharpener as set forth in claim 3 wherein the first link is supported at a fixed location relative to the sharpening surface and pivots about a fixed axis parallel to said first orthogonally related pivot axis, and the blade holder is supported on a distal end of said second link and is pivotable about an axis that during a sharpening operation is substantially parallel to said fixed axis.

5. A sharpener as set forth in claim 4 including a spring that biases the blade support in one of said directions.

6. A sharpener for blades comprising first and second wheels each having an arcuate blade-sharpening surface and rotatable in the same direction on a common axis, two stationary blade guides, each located adjacent to a different one of said surfaces, and a movable support for a blade, said support comprising a blade holder and pivotally interconnected first and second links, the first link pivotably supported at a location fixed with respect to the blade guides and midway between the two wheels, the second link supporting the blade holder adjacent a distal end of the second link, the two links together supporting the blade holder for movement in first directions toward and away from either blade-sharpening surface, in second directions transverse to the first directions, and in third directions transverse to the first and second directions, wherein the blade holder is movable simultaneously in two of said three directions during sharpening of a blade held by said blade holder, said blade holder being pivotably supported on the second link, the links and pivots being located and arranged to support the blade holder adjacent either blade guide for movement in three substantially mutually perpendicular directions relative to either blade guide and blade-sharpening surface.

7. A sharpener as set forth in claim 6 wherein the pivotal interconnection between the first and second links has first and second pivots with orthogonally related axes.

8. A sharpener as set forth in claim 7 wherein one of said pivots permits rotation of the second link and blade holder through 180 degrees from one side of the first link to the opposite side, moving the blade holder in a plane in which the blade holder pivot axis lies.

9. A method of sharpening an elongated curved blade defining a blade edge lying in a plane comprising:

moving a sharpening surface along a predetermined path of travel, said surface having a width substantially less than the extent of said blade;

stationing a blade engaging guide adjacent said path of travel;

fixedly supporting said blade on a blade support with said blade edge projecting away from said support and with said plane extending tangentially with respect to said sharpening surface;

resiliently urging said blade into engagement with said guide;

engaging said blade edge with said sharpening surface adjacent said guide so that said blade edge plane is to tangential to said sharpening surface and said blade curve is engaged with the guide;

shifting said blade support to move said blade edge across said sharpening surface and shifting said blade support in a second direction parallel to the plane of said blade edge while maintaining said blade in engagement with said guide and said surface.

10. The method of claim 9 wherein moving a sharpening surface comprises rotating a blade sharpening wheel defining said surface on a periphery thereof.

11. The method of claim 10 wherein shifting said blade support in a direction transverse to the extent of said blade while maintaining said blade in engagement with said guide and said surface comprises pivoting said blade support about an axis remote from said blade support.

* * * * *